US005394666A

United States Patent [19]

Zahner, III

[11] Patent Number: 5,394,666

[45] Date of Patent: Mar. 7, 1995

[54] INVERTED SEAM ROOF COVERING SYSTEM

[75] Inventor: L. William Zahner, III, Kansas City, Mo.

[73] Assignee: A. Zahner Sheet Metal Company, Kansas City, Mo.

[21] Appl. No.: 183,296

[22] Filed: Jan. 18, 1994

Related U.S. Application Data

[63] Continuation of Ser. No. 771,056, Oct. 2, 1991.

[51] Int. Cl.[6] ..... E04B 7/00; E04D 1/36; E04D 3/366

[52] U.S. Cl. ..... 52/302.3; 52/302.1; 52/464; 52/511; 52/745.06; 52/747; 52/506.05

[58] Field of Search ..... 52/14, 22, 58, 60, 61, 52/302.1, 302.2, 302.3, 460, 461, 464, 463, 506.5, 511, 745.06, 747

[56] References Cited

U.S. PATENT DOCUMENTS

| | | | |
|---|---|---|---|
| 835,966 | 11/1906 | Lyster . | |
| 1,247,743 | 11/1917 | Thompson . | |
| 1,332,638 | 2/1920 | Slatten | 52/461 |
| 1,602,638 | 10/1926 | Bonsall . | |
| 2,150,130 | 3/1939 | Ragsdale et al. . | |
| 2,151,234 | 3/1939 | Rutten et al. . | |
| 2,356,833 | 8/1944 | Doe . | |
| 2,408,557 | 10/1946 | Huntington . | |
| 2,552,092 | 5/1951 | Goodwin . | |
| 2,590,708 | 3/1952 | Jurasevich | 52/464 |
| 2,640,669 | 6/1953 | Ashford | 52/511 X |
| 2,653,686 | 9/1953 | Routt | 52/511 X |
| 2,855,871 | 10/1958 | Huntington | 52/461 |
| 2,969,754 | 1/1961 | Wilson | 52/511 X |
| 3,173,228 | 3/1965 | Roberts . | |
| 3,318,055 | 5/1967 | Piana | 52/22 |
| 3,327,443 | 6/1967 | Gay et al. | 52/460 |
| 3,336,705 | 8/1967 | Vecchiarelli | 52/302.3 X |
| 3,411,259 | 11/1968 | Anderson et al. | 52/14 |
| 3,574,965 | 4/1971 | Pierce . | |
| 3,603,056 | 9/1971 | Roth et al. . | |
| 3,832,820 | 9/1974 | Eggert . | |
| 3,984,958 | 10/1976 | Murray . | |
| 4,034,530 | 7/1977 | Vallee . | |
| 4,058,950 | 11/1977 | Vallee . | |
| 4,068,439 | 1/1978 | Andersen | 52/506 X |
| 4,106,252 | 8/1978 | Rutten . | |
| 4,184,299 | 1/1980 | East . | |
| 4,280,484 | 7/1981 | Mancosu | 52/506 X |
| 4,321,780 | 3/1982 | Hooper . | |
| 4,388,789 | 6/1983 | Murphy . | |
| 4,423,581 | 1/1984 | Miller . | |
| 4,583,339 | 4/1986 | Cotter . | |
| 4,590,730 | 5/1986 | Blendick | 52/46 |
| 4,671,038 | 6/1987 | Porter . | |
| 4,789,116 | 12/1988 | Eftestol | 52/14 |
| 4,922,670 | 5/1990 | Naka et al. | 52/747 X |
| 4,959,939 | 10/1990 | Buchanan . | |

FOREIGN PATENT DOCUMENTS

| | | | |
|---|---|---|---|
| 552676 | 2/1958 | Canada | 52/461 |
| 1070030 | 7/1954 | France | 52/464 |
| 1155899 | 10/1963 | Germany | 52/387 |
| 513307 | 2/1955 | Italy | 52/204 |
| 35155 | 2/1990 | Japan | 52/464 |

*Primary Examiner*—Carl D. Friedman
*Assistant Examiner*—Robert J. Canfield
*Attorney, Agent, or Firm*—Hovey, Williams, Timmons & Collins

[57] ABSTRACT

A metal roof panel attachment system produces a finished roof surface presenting an overall smooth, planar configuration. Adjacent planar panels are attached to secondary support members which form a recessed joint incorporating a concealed drainage channel. Front and rear eave and rake sections are installed at the perimeter of the roof to form a finished, moisture-proof joint between the roof and walls. An outwardly extending flange directs water flow away from the walls of the structure.

14 Claims, 2 Drawing Sheets

10
12
14
16
18
20
24
26
30
32
34
36
38
40
42
44
46
48
50
52
54
56
58
60
62
64
70
72
74
76
78
80
82

INVERTED SEAM ROOF COVERING SYSTEM

This application is a continuation of application Ser. No. 07/771,056, filed Oct. 02, 1991.

BACKGROUND OF THE INVENTION

1. Field of the Invention

The present invention is broadly concerned with an improved metal roof panel attachment system which produces a finished roof surface having an overall smooth, planar configuration. More particularly it is concerned with a system in which adjacent planar panels are attached to secondary support members which form a recessed joint incorporating a concealed drainage channel.

2. Description of the Prior Art

Prior art panel attachment systems for vertical, sloped or horizontal surfaces employed standing seams secured against moisture penetration by battens, or interlocking, so called "flat" seams secured by sealing or soldering. Both methods produce an upstanding seam which extends outwardly from the surfaces of the panels and thus, the overall finished appearance of surfaces incorporating such seams is not smooth and flat.

In such prior art systems the panels are held in place by clips or fasteners, or the adjacent panels are interlocked into fastened seams. The upstanding seams are secured by crimping, interlocking, or soldering to prevent penetration of moisture to the back sides of the panels and the underlying roof or wall surface. These attachment points are rigidly fixed, and consequently thermal expansion and contraction stresses accumulate around these points, causing wear. Moreover, the strength of such panel systems is dependent upon the secondary clips or fasteners.

Previous interlocking "flat" seams depend on a gasket or sealant as the main barrier to moisture infiltration. Such seams are subject to deterioration caused by exposure to temperature extremes and ultraviolet radiation, in addition to wear caused by thermal movements of the panels.

Installation of panels using previous attachment systems requires fastening the panels into fixed positions with exposed fasteners or clips, interlocking the seams by aligning and engaging battens over the clips, or by crimping or secondary machine seaming. Skilled labor and specialized crimping and seaming machinery are required for such installation. Single panels damaged during installation or thereafter cannot easily be removed without affecting adjacent panels.

SUMMARY OF THE INVENTION

The present invention overcomes the problems previously outlined and provides a greatly improved metal panel attachment system. That is to say, the panels are easily installed in a single operation without specialized equipment to present a strong, flat, surface without stress points, exposed fasteners, standing seams or ribs and having a concealed drainage system. Individual panels in the system can be removed easily without affecting adjacent panels. The joint between panels allows for unrestricted thermal expansion and contraction without accumulation of stresses at attachment points.

Broadly speaking, the system includes a plurality of metal panels, drainage channels for spanning the joint areas between adjacent panels, and retainers for securing the panels to the drainage channels so that the installed panels present a smooth, planar configuration. The longitudinal edges of the panels are formed into flanges which at spaced intervals include tab structures for locking into slots formed in the retainers.

In preferred roof applications, front and rear eave and side rake sections are installed at the perimeter of the roof to form a finished, moisture-proof joint between the roof and walls. In addition, a laterally extending flange directs water flow outwardly, away from the side of the building.

DESCRIPTION OF THE PREFERRED EMBODIMENT

Figures 1, 2, 3:
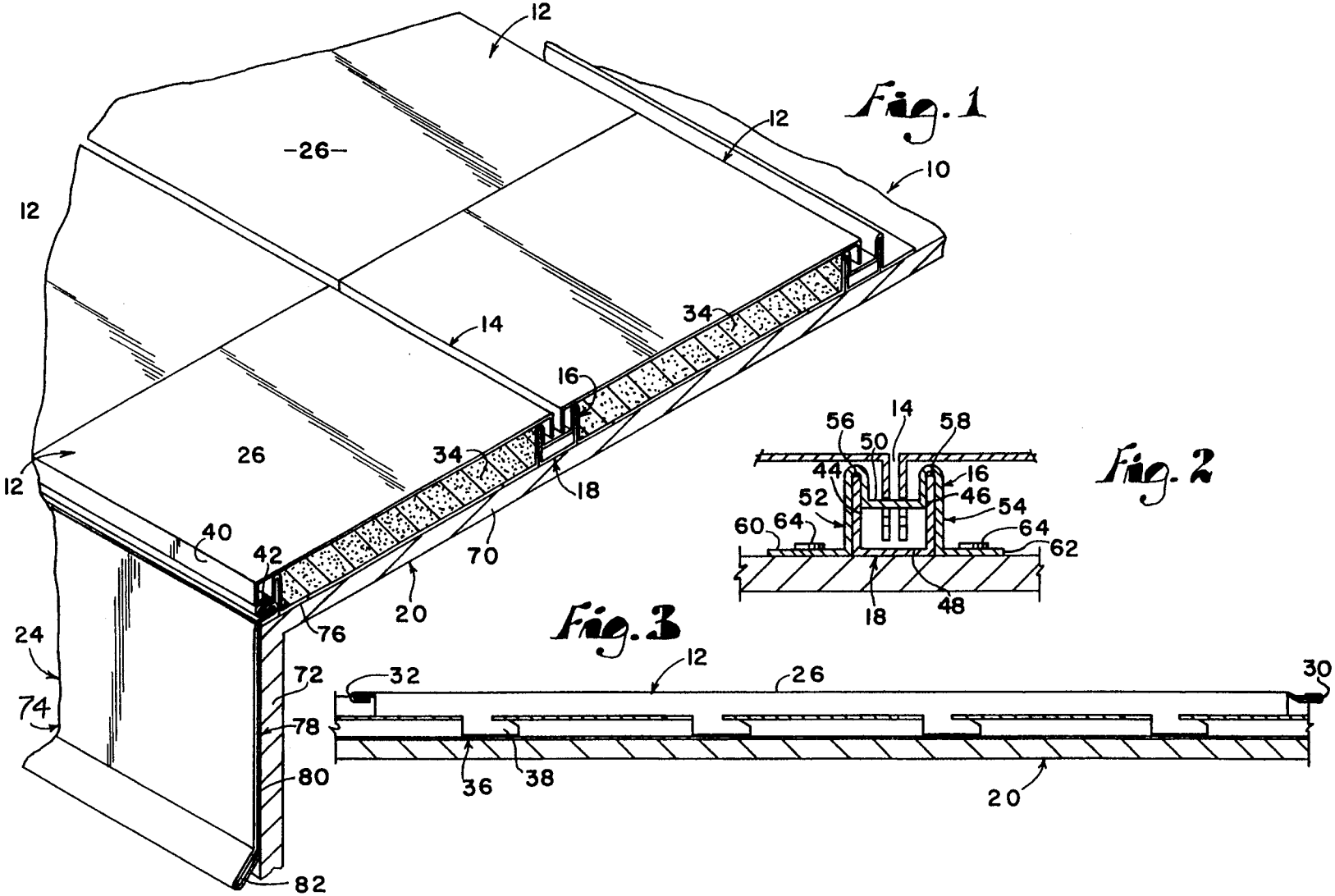
FIG. 1 is a partial perspective view of a roof including the rake, in accordance with the invention.
FIG. 2 is a cross section of a joint area of FIG. 1.
FIG. 3 is a side sectional view of a joint area of FIG. 1, showing the locking tabs engaged in slots.
Figure 6:
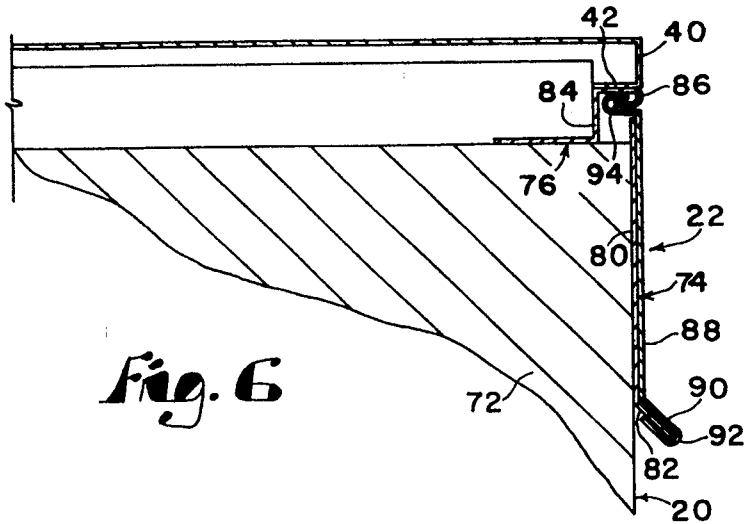
FIG. 6 is a side sectional view of the eave shown in FIG. 5.

Referring now to the drawings, an inverted seam roof panel attachment system 10 in accordance with the invention broadly includes roof panels 12 installed in adjacent, side-by-side relationship with recessed joint areas 14 therebetween. Panels 12 are coupled with retaining members 16 which conceal and secure drainage channels 18 and are in turn attached to nailable surface 20. As shown in FIGS. 1 and 6, eave sections 22 depend perpendicularly from the front and rear margins of the roof, and rake sections 24 depend perpendicularly from the side margins to form a finished perimeter which is impervious to moisture. Retaining members 16 are located relative to joint areas 14 to permit drainage from panels 12 to flow into channels 18, and include structure for securing both panels 12 and channels 18 to nailable surface 20.

In more detail, the panels 12 are of integral construction and are generally rectangular, each including a planar portion 26 and flanges 28 depending perpendicularly from the longitudinal panel margins. As best shown in FIG. 3, the forward margin of planar portion 26 is folded upwardly and rearwardly into a lip 30, while the rearward margin is folded downwardly and forwardly into a lip 32 for coupling the panels in end-to-end relationship by mating engagement of the corresponding lips. In certain preferred embodiments where a particularly strong surface is required, as, for example a roof subject to impact or walking loads, a rigid underlayment may be employed between retaining members 16 to provide support below panel surface 20. Alternatively or in addition, insulation, such as rigid polystyrene foam 34 may be similarly employed.

Figure 5:
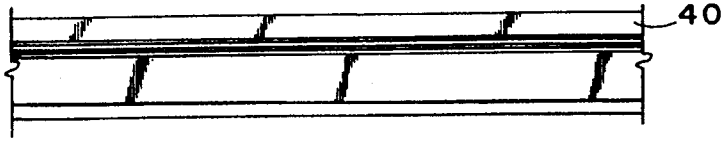
FIG. 5 is a front elevational view of the eave portion of a roof of the invention.

At intervals, longitudinal flanges 28 extend downwardly to form coplanar locking tabs 36, each presenting a forwardly extending foot portion 38. As shown in FIGS. 1, 5, and 6, panels 12 disposed at the perimeter of the roof are constructed with a depending hem 40 and inwardly extending lip 42 at the perimeter margin in lieu of the respective flange 28 or lip 30,32.

Figure 4:
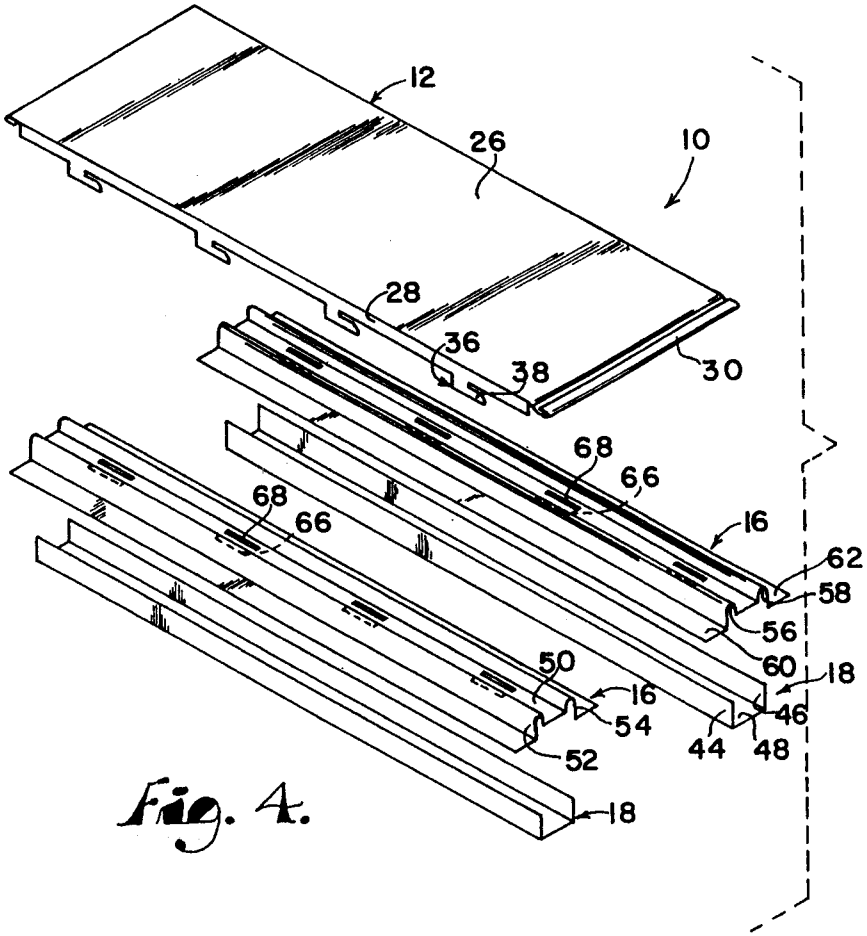
FIG. 4 is an exploded view of a panel and adjacent joint areas of the roof system of FIG. 1.

As best shown in FIGS. 1, 2 and 4, channel 18 is preferably of integral construction and includes a pair of opposed upstanding walls 44, 46 interconnecting an elongated flat bottom portion 48. Retaining member 16, in preferred forms also of integral construction, includes a flat recessed central portion 50 interconnecting a pair of opposed legs 52,54. The uppermost portion of each leg presents a longitudinally and downwardly extending groove 56,58 for receiving upstanding channel walls 44,46. Flanges 60,62 extend laterally from the lowermost portion of legs 52,54 respectively to permit fastening of retaining member 16 to nailable surface 20 with nails 64 or other suitable fasteners. In this manner, channel 18 is held in place against nailable surface 20 without the need for insertion of fasteners through the channel bottom 48, and the waterproof surface of channel 18 remains intact.

Pairs of spaced parallel slots 66,68 extend longitudinally at intervals corresponding to the spacing of panel tabs 36 along the central portion 50 of each retaining member 16 to receive tabs 36 for securing a pair of panels 12 in covering relationship to flanges 60, 62 and fasteners 64. This construction permits drainage, such as moisture, including particulate matter such as dirt or ice from the panels to pass into the joint area 14, through retainer slots 66,68, and into concealed channel 18 and away from the panels while preventing penetration of moisture to nailable surface 20. In addition, slots 66,68 permit panels 12 to expand and contract without restriction or accumulation of stresses around attachment points. In one embodiment a gasket (not shown), which may be fabricated of rubber or synthetic resinous material, is inserted into joint area 14 in sealing relationship between longitudinal panel flanges 28 to provide a secondary seal against moisture penetration.

For exterior applications, as shown in FIG. 1, nailable surface 20 may include a roof 70 or walls 72. In roof installations, eave 22 and rake 24 are installed at the perimeter to form a finished joint between the roof and walls. As best shown in FIGS. 1 and 6, eave 22 and rake 24 sections are substantially identical, each including fascia 74, a fascia cleat 76, and fascia nailer 78.

Nailer 78 is nailed or otherwise secured circumferentially to wall surface 72, and includes an elongated rectangular panel 80 the lowermost margin forming an obtusely angled flange 82. As previously described, the perimeter margin of roof panels 12 presents a depending hem 40 and inwardly extending lip 42. Cleat 76 includes a portion of approximate dog-legged cross section 84 which is configured to extend beneath panel 12 and to support panel lip 42 when the cleat is installed at the perimeter of the roof. Thus nails or other fasteners used to secure the cleat are not exposed, but are covered by planar panel portions 26. The perimeter-facing portion of cleat 76 is folded downwardly and inwardly to form a lip portion 86.

Fascia 74 includes an elongate rectangular planar portion 88, the lower margin presenting an obtusely angled flange 90 for directing runoff from the roof outwardly away from the structure. Flange 90 is folded downwardly and inwardly at the margin to form a groove 92 for receiving congruently angled nailer flange 82 when fascia 74 is installed in a covering relationship over nailer 78. The uppermost margin of fascia 74 is folded transversely inwardly to form a lip 94 for mating engagement with cleat lip 86. In this manner, cleat 76 and nailer 78 cooperatively secure fascia 74 which circumscribes the perimeter of the joint between roof and walls in covering relationship.

Panel attachment system 10 is preferably employed for exterior cladding such as roofs and walls. This system, however, is versatile and may be employed for architectural details such as columns, or for anchoring interior panels as well. In such interior applications drainage channel 18 may be omitted.

The components of the system are preferably of sheet metal construction of 10 gauge (0.125 inches; 0.32 cm) to 24 gauge stainless steel, galvanized steel, aluminum, copper, brass, or any suitable metal or synthetic resin material. Panels 12 are preferably of generally rectangular shape, however the ends or sides may be tapered to a trapezoidal shape for special architectural applications. They are roll formed in 20 to 40 foot (6.1 to 12.2 meter) lengths. In especially preferred embodiments, panels 12, retaining members 16, and channels 18 are of unitary construction, although spot welding of components may be employed, with tabs 36 and slots 66, 68 formed by punching.

In use, channels 18 are installed in end-over-end overlapping manner at predesigned spaced intervals along a surface 20. Retaining members 16 are similarly installed in covering relationship to channels 18 with grooves 56,58 receiving channel walls 44,46. Retaining members 16 are secured to nailable surface by nails or other suitable fasteners 64 which extend through flanges 60,62 and into nailable surface 20. The flanges 60,62 extend laterally away from channel 18 along the roof surface 70 and may be apertured at spaced intervals to facilitate insertion of the fasteners where this is warranted by the gauge of the material.

As best shown in FIGS. 1 and 4, a pair of panels is installed on either side of retaining member 16 by inserting tabs 36 into slots 66,68 and sliding the panels forward until tab feet 38 reach the ends of the slots 66,68, thus positively locking the panels into place. Where one panel is to be installed behind another, the forward panel lip 30 is slid under the rearward lip 32 of the preceding panel and the remainder of the installation procedure is repeated.

In this manner panel attachment system 10 forms a strong, moisture proof joint 14 between adjacent panels having an inverted seam rather than a batten or standing seam. The finished joint presents a flat profile. Advantageously, since battens or joint covers are not employed, the roof is installed in a single operation and it is not necessary to walk back over the surface to attach joint covers. Since panel tabs 36 are movable within slots 66,68, loading does not concentrate stresses at such fixed attachment points as clips or fasteners, and the resulting roof is extremely strong.

At the perimeter of the roof, cleats 76 are nailed or otherwise suitably fastened to roof surface 70 and nailers 78 are similarly installed at the uppermost perimeter of the wall surface 72. Fascia 74 are installed by slidably engaging nailer flange 82 with fascia groove 92 and by pushing uppermost fascia lip 94 into engagement with cleat lip 86. Panels 12 are installed as previously described with the panel hem 40 facing the perimeter margin and lip 42 supported by cleat leg 84.

In this manner, the finished surface presents panels 12, joints 14, which conceal drainage channels 18, and eave and rake portions 22,24, which are angled outwardly to direct drainage away from the roof/wall joint. Advantageously, the roof surface presents no exposed fasteners. Fasteners 64 employed to secure retaining members 16 are covered by panels 12, and fasteners employed to secure cleats and nailers are covered by panels 12 and fascia 74 respectively. A gasket may be inserted into the joint area 14 to provide secondary protection against moisture penetration.

Having described the preferred embodiments of the present invention, the following is claimed as new and desired to be secured by Letters Patent.

I claim:

1. A roof covering system comprising:

a plurality of panels, each of said panels presenting four sides, with an opposed two of said sides each including a depending marginal member, adjacent ones of said panels presenting a joint area therebetween;

channel means configured for spanning said joint area below said marginal members in a joint spanning and draining relationship therewith for receiving any roof drainage matter passing through said joint area, preventing passage therethrough and for channeling said matter away from aid roof; and retaining means for coupling said channel means with said adjacent ones of said panels in said joint spanning and draining relationship, wherein each depending marginal member terminates in a plurality of tab structures for engagement by said retaining means for coupling said panels with said channel means, the other opposed two of said sides each including a lip member for mating engagement with a corresponding lip member of an adjacent one of said panels.

2. The roof covering system as set forth in claim 1, wherein each depending marginal member includes a tab structure extending longitudinally and said retaining means includes structure defining a tab receiving slot for receiving said tab structure therein, thereby coupling said panels with said channel means.

3. The roof covering system as set forth in claim 1 wherein said lip member is integrally formed as a part of said panels.

4. The roof covering system as set forth in claim 1, wherein said channel means comprises a member of generally U-shape including a pair of elongated opposed legs and said retaining means includes structure shaped for receiving said channel means.

5. A system for attaching metal roof panels having longitudinally and downwardly extending flanges presenting tab structures to an underlying roof structure comprising:

a plurality of elongated channel members disposed in side-by-side relationship on said roof structure, each of said channel members having a pair of opposed longitudinally upstanding flange portions;

a plurality of elongated retaining members for mounting in covering relationship to said channel members for securing said channel members to said underlying roof structure, said retaining members including structure defining a pair of parallel spaced longitudinally extending grooves for receiving said channel flange portions, said structure including longitudinally spaced tab receiving slots disposed between said grooves for mating engagement with said tab structures for securement of said roof panels.

6. A covering system comprising:

a plurality of panels, each presenting a depending marginal member, adjacent ones of said panels presenting a joint area therebetween;

channel means configured for spanning said joint area below said marginal members in a joint spanning and draining relationship therewith for receiving any drainage matter passing through said joint area, preventing passage therethrough and for channeling said matter away from said joint area; and retaining means for coupling said channel means with said adjacent ones of said panels in said joint spanning and draining relationship, wherein one of said marginal member and retaining means includes a tab and the other of said marginal member and retaining means including structure defining a tab receiving slot for coupling said channel means with said panel.

7. A covering system comprising:

a plurality of covering panels each presenting a pair of opposed, depending marginal members;

a drainage channel; and retaining means for coupling one of said marginal members of one of said panels in a side-by-side relationship with one of said marginal members of another one of said panels thereby forming a joint area between said side-by-side marginal members, said drainage channel including structure for spanning said joint area below said marginal members, said retaining means including means for coupling said drainage channel in a spanning relationship with said joint area below said marginal members for receiving any drainage matter passing through said joint area and for channeling said drainage matter away from said joint area, one of said marginal members and retaining means including a tab and the other of said marginal members and retaining means including a tab-receiving slot for receiving said tab for coupling said marginal members in said side-by-side relationship.

8. The system as set forth in claim 7, said panels including roof covering panels.

9. The system as set forth in claim 7, said panels being composed of sheet metal.

10. The system as set forth in claim 7, said drainage channel presenting a generally U-shaped configuration having a pair of opposed, upstanding legs, said retaining means including means for coupling said channel in a spanning relationship with said joint area with a portion of said side-by-side marginal members between said upstanding legs.

11. The system as set forth in claim 7, each of said marginal members each including a plurality of said tabs, said retaining means including a corresponding plurality of said tab-receiving slots.

12. The system as set forth in claim 11, said tabs being integral with said marginal members.

13. The system as set forth in claim 7, said retaining means including means for coupling with a surface to be covered by said covering system and with said channel between said retaining means and the surface.

14. The system as set forth in claim 7, said panels each including a planar portion between said marginal members thereof, said retaining means including means for coupling said marginal members and thereby the associated panels thereof so that the planar portion of each of said panels lie in the same plane.

* * * * *